US005702181A

United States Patent [19]

Wright

[11] Patent Number: 5,702,181

[45] Date of Patent: Dec. 30, 1997

[54] PUG MILL WATER FLOW CONTROL SYSTEM

[76] Inventor: Ernest H. Wright, 78433 Prestwood La., Mooresville, N.C. 28115

[21] Appl. No.: 542,721

[22] Filed: Oct. 13, 1995

[51] Int. Cl.[6] ..... B28C 7/12

[52] U.S. Cl. ..... 366/40; 366/151.1

[58] Field of Search ..... 366/151.1, 152.1, 366/152.2, 162.1, 167.1, 182.1, 182.2, 348, 141, 76.1, 76.2, 76.93, 40, 182.4

[56] References Cited

U.S. PATENT DOCUMENTS

| | | | |
|---|---|---|---|
| Re. 32,206 | 7/1986 | Bracegirdle | 366/7 |
| 2,693,018 | 11/1954 | Czarnecki . | |
| 2,787,450 | 4/1957 | Wylie | 366/40 |
| 2,904,267 | 9/1959 | Lyons . | |
| 3,259,374 | 7/1966 | Doebl et al. . | |
| 3,574,345 | 4/1971 | Brociner . | |
| 3,578,298 | 5/1971 | Hurlbut . | |
| 3,717,162 | 2/1973 | Pescott . | |
| 3,942,767 | 3/1976 | Hanzawa et al. | 366/152.1 |
| 3,968,903 | 7/1976 | Resentreter et al. | 222/1 |
| 4,245,915 | 1/1981 | Bracegirdle | 366/151.1 |
| 4,304,289 | 12/1981 | McMullen | 164/155.6 |
| 4,384,787 | 5/1983 | Ito et al. | 366/40 |
| 4,502,834 | 3/1985 | Jackson . | |
| 4,721,448 | 1/1988 | Irish et al. | 366/182.4 |
| 5,023,028 | 6/1991 | Kamiguchi et al. . | |
| 5,148,775 | 9/1992 | Peet . | |
| 5,169,307 | 12/1992 | Frye . | |
| 5,179,521 | 1/1993 | Edge . | |
| 5,330,265 | 7/1994 | Keating, Jr. et al. | 366/40 |
| 5,340,214 | 8/1994 | Juzwaik | 366/299 |

*Primary Examiner*—Tony G. Soohoo

*Attorney, Agent, or Firm*—Rhodes Coats & Bennett, L.L.P.

[57] ABSTRACT

An apparatus for controlling the flow of water to a pug mill. A water supply system is connected to the pug mill for providing a flow of water to the pug mill. The water supply system includes an inlet line connected to a supply of water; a pump connected to the inlet line; an outlet line connected between the pump and the pug mill; a return loop connected between the outlet line and the inlet line; and bypass means for selectively controlling the flow of water between the pug mill and the return loop. The invention also includes a control system having a moisture sensor for providing a signal representative of the moisture level of the clay feed material. A flow transmitter is located between the water supply and the pug mill for providing a signal representative of the water flow to the pug mill. A control valve is located between the water supply and the pug mill for controlling the flow of water to the pug mill. A controller is connected between the moisture sensor, the flow transmitter and the control valve for receiving the signal representative of the moisture level of the clay feed material and the signal representative of the water flow to the pug mill and providing a control signal to the control valve to control the flow of water to the pug mill.

52 Claims, 2 Drawing Sheets

PUG MILL WATER FLOW CONTROL SYSTEM

BACKGROUND OF THE INVENTION (1) Field of the Invention

The present invention relates generally to brick making and, more particularly, to a control system for controlling the water flow to a pug mill.

(2) Description of the Prior Art

In brick making, raw materials are fed into a pug mill where water is added and mixed with the raw materials to form a product feed which, in turn, is fed to an extruder for forming the slug from which the individual bricks are cut. The amount of water in the feed directly influences the extruded column stiffness from the extruder. If the column is too stiff, it can not be properly processed to form bricks. If the column is too soft, it can be cut, but the finished product is soft and difficult to handle and stack for firing.

Extruded column stiffness if a very difficult parameter to measure. There is no known method of measuring the stiffness of a moving extruded column without defacing it. It has, therefore, been necessary to find other parameters that can be measured and are in phase or change as column stiffness changes.

Early methods of controlling the amount of water flow to the pug mill did not include any feed-back means from the extruded column stiffness. For example, in one method, a water supply is fed by a pump through a rotameter into spray nozzles located in the pug mill. A flow control valve is located between the spray nozzles and the rotameter and is activated to allow water to flow to the spray nozzles only when the pug motor is in operation. This system is relatively inexpensive and simple. However, this approach is expensive to operate since it requires constant monitoring. Also, a rotameter is a very inaccurate measurement of water flow. For example, water flow changes due to changes in the pump discharge pressure and restriction of the flow nozzles can be great enough in magnitude to effect column stiffness but may not be discernable by the rotameter. A variation of this system uses a water tank to provide constant head pressure. Unfortunately, this is an expensive solution to the problem because of the cost of a tank and it does not compensate for water flow changes due to changes and restriction of the spray nozzles.

A second method of controlling the water flow to a pug mill has been based on monitoring the extruder lubrication oil pressure at different locations and using a plurality of pressure switches to control cut-off valves located on the spray nozzles. While this is a relatively inexpensive technique, in practice it produces a water flow that is inaccurate and not repeatable. This is due to the fact that the water flow changes due to changes in the pump discharge pressure and restriction of the spray nozzles and also that there is no direct control of the water flow rate to the spray nozzles because cutting on individual cut-off valves results in either too much or too little water.

Thus, there remains a need for a new and improved water flow control system for a pug mill which is inexpensive to operate and compensates for water flow changes due to changes in pump discharge pressure, restriction of the spray nozzles, and/or operation of additional user valves elsewhere in the plant.

SUMMARY OF THE INVENTION

The present invention is directed to a water flow control system for a pug mill for mixing water and clay to form a feed material and an extruder located downstream of the pug mill for receiving the feed material and for forming an extruded slug.

A water supply system is connected to the pug mill for providing a flow of water to the pug mill. The water supply system includes an inlet line connected to a supply of water; a pump connected to the inlet line; an outlet line connected between the pump and the pug mill; a return loop connected between the outlet line and the inlet line; and bypass means for selectively controlling the flow of water between the pug mill and the return loop.

The invention also includes a control system having a moisture sensor transmitter for providing a signal representative of the moisture level of the clay feed material. A flow transmitter is located between the water supply and the pug mill for providing a signal representative of the water flow to the pug mill. A control valve is located between the water supply and the pug mill for controlling the flow of water to the pug mill. A controller is connected between the moisture sensor, the flow transmitter and the control valve for receiving the signal representative of the moisture level of the clay feed material and the signal representative of the water flow to the pug mill and providing a control signal to the control valve to control the flow of makeup water to the pug mill.

Accordingly, one aspect of the present invention is to provide an apparatus for controlling the flow of water to a pug mill. The apparatus includes: (a) a pug mill for mixing water with a clay feed material; (b) a water supply system connected to the pug mill, the water supply system including a supply of water and a first control valve for controlling the flow of water to the pug mill; (c) a moisture sensor for measuring the moisture content of the feed material upstream of the pug mill; and (d) a controller connected between the moisture sensor and the first control valve for receiving a signal representative of a moisture content of the feed material and providing a control signal to the first control valve to control the flow of water to the pug mill.

Another aspect of the present invention is to provide a control system for an apparatus for controlling the flow of water from a water supply to a pug mill for mixing water with a clay feed material received from a feed material supply upstream of the pug mill. The control system includes: (a) a moisture sensor located adjacent to the feed material supply for providing a moisture signal representative of the moisture content of the feed material upstream the pug mill; (b) a flow transmitter located between the water supply and the pug mill for providing a water flow signal representative of the water flow to the pug mill; (c) a control valve located between the water supply and the pug mill for controlling the flow of water to the pug mill; and (d) a controller connected between the moisture sensor, the flow transmitter and the first control valve for receiving the moisture signal and the water flow signal and providing a water control signal to the control valve to control the flow of water to the pug mill.

Still another aspect of the present invention is to provide an apparatus for controlling the flow of water to a pug mill. The apparatus includes: (a) a pug mill for mixing water with a supply of clay feed material; (b) a water supply system connected to the pug mill, the water supply system including a supply of water and a first control valve for controlling the flow of water to the pug mill, wherein the water supply system further includes an inlet line connected to a supply of water; a pump connected to the inlet line; an outlet line connected between the pump and the pug mill; a return loop connected between the outlet line and the inlet line; and a flow bypass for selectively controlling the flow of water between the pug mill and the return loop; (c) a moisture sensor located adjacent to the feed material supply for providing a moisture signal representative of the moisture content of the feed material upstream the pug mill; (d) a flow transmitter located between the water supply and the pug mill for providing a water flow signal representative of the water flow to the pug mill; and (e) a controller connected between the moisture sensor, the flow transmitter and the first control valve for receiving the moisture signal and the water flow signal and providing a water control signal to the control valve to control the flow of water to the pug mill.

These and other aspects of the present invention will become apparent to those skilled in the art after a reading of the following description of the preferred embodiment when considered with the drawings.

DESCRIPTION OF THE PREFERRED EMBODIMENTS

Figure 1:
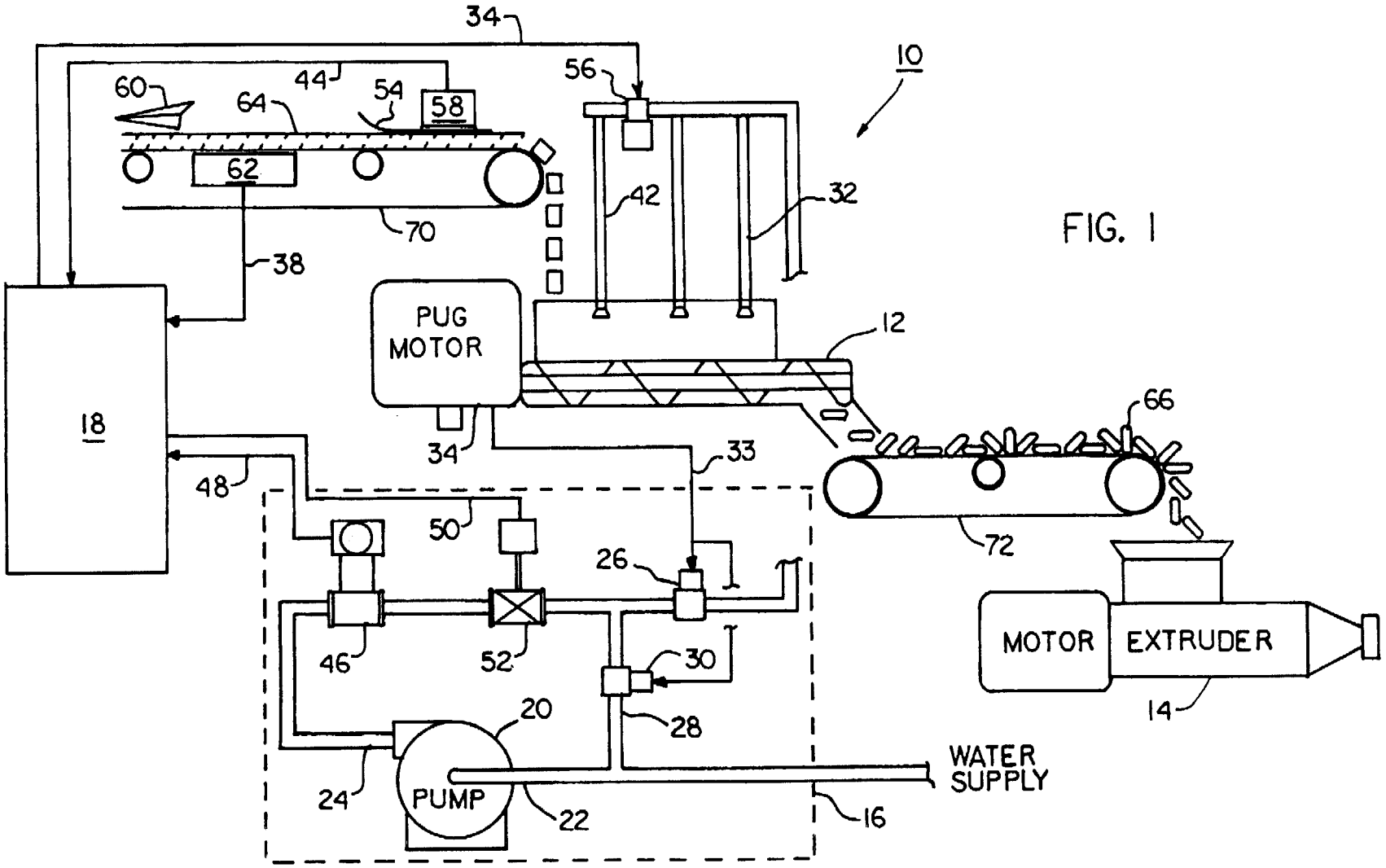
FIG. 1 is a schematic representation of a pug mill using a water flow control system constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a water flow control system for a pug mill or the like, generally designated 10, is shown constructed according to the present invention. A pug mill water flow control system 10 generally includes a pug mill 12, an extruder 14, a water supply system generally designated 16, and a controller 18. Controller 18 receives input signals from a microwave moisture sensor 58 and weight scales 62 and provides a control signal to water supply 16 to control the water flow to pug mill 12.

In the preferred embodiment, water supply system 16 includes a high capacity pump 20 having an inlet line 22 connected to a water supply and an output line 24. A flow direction control valve 26 is connected between pump 20 and pug mill 12 to control the flow of water to the pug mill. Also in the preferred embodiment, the water supply system 16 includes a return loop 28 connected between the output 24 and the inlet 22 and a flow direction control valve 30.

In operation, flow direction valve 26 is normally opened to supply water to spray nozzles 32 while flow direction control valve 30 is closed. In the preferred embodiment, flow direction control valve 26 is normally closed and flow direction control valve 30 is normally open, thereby providing a path for the water to recirculate through the pump 20 when pug mill 12 is not running. When pug mill 12 is operated, a signal 33 is sent from the pug motor 34 to open the flow direction control valve 26 and close the flow direction control valve 30, thereby permitting water to flow to spray nozzles 32. Continuously operating the pump 20 minimizes changes in water pressure due to pump start up as the pug mill is cycled between shut down and start up.

Water supply system 16 includes a flow transmitter 46 for providing a water flow rate control signal 48 to controller 18. Moisture sensor 58 sends a moisture sensor signal 44 to controller 18. Scales 62 provide a weight signal 38 to controller 18. generally, in response to moisture sensor signal 44, weight signal 38, and water flow rate control signal 48, controller 18 provides a control signal 50 to a flow rate control valve 52 to control the rate of water flow to spray nozzles 32. Also, in the preferred embodiment, controller 18 also provides an auxiliary flow rate control signal 34 to an auxiliary flow rate control valve 56 which controls additional flow nozzles 42 when the water flow is greater than a predetermined set point, for example, 6 gallons per minute.

As shown in FIG. 1, the process of brick making, according to the present invention, is as follows. A feed material 64, comprising substantially of clay along with sand and water among other ingredients, is fed into the system 10 on conveyor system 70. Conveyor system 70 typically includes a continuous conveyor along the bottom of a trough (FIG. 1 depicts a cross-section of conveyor system 70). Large particles in the feed material 64 are deflected from conveyor system 70 by the large particle deflector (or plow) 60. The large particle deflector 60 should be configured to either repel or submerse the large particles and not to catch the particles and roll them in the feed material thereby creating a snowball effect. As the feed material 64 travels along the conveyor system 70, it is weighed by the scales 62 mounted under conveyor system 70 in a manner providing accurate weight measurements of the feed material 64. The weight measurement is sent to controller 18 via the weight control signal 38.

The feed material 64 continues along conveyor system 70 and passes under the microwave moisture sensor 58. A moisture sensor signal 44, representative of the percentage of moisture present in the feed material 64, is sent to controller 18. The microwave moisture sensor 58 includes a skid 54 which rides along the top of the feed material 64. As depicted, the skid 54 has an upwardly curved end portion in a direction against the flow of the feed material 64 to prevent the skid from digging into the feed material 64. Since clay tends to stick to virtually everything, it has been found that if the moisture sensor skid 54 is ceramic and heated approximately 20 degrees Fahrenheit above the ambient temperature of the feed material 64, the feed material 64 will not stick to the skid 54. It is very important not to allow any accumulations on the skid 54, because such accumulations will adversely affect the moisture sensor. 58. Additionally, the microwave moisture sensor 58 is adversely affected if the angular orientation is changed after calibration. For example, if the moisture sensor 58 is tilted in any direction, the moisture percentage reading will be incorrect. Those of ordinary skill in the art will recognize that the microwave moisture sensor discussed herein is only one moisture sensing device available and that any moisture sensing devices used according to the teachings of the current invention is within the scope of the current invention and claims.

Immediately following the moisture percentage measurement, the feed material 64 is fed into the pug mill 12 which is driven by the pug motor 34. The pug mill 12 thoroughly mixes additional water to the feed material 64. The object of the invention is to add enough water to the feed material 64 to bring the moisture content to an ideal level. The water is added to the feed material 64 in feed mill 12 by spray nozzles 32 and potentially, the optional spray nozzles 42. The operation of the water supply 16 is discussed in detail below. The output of the pug mill 12 is a moisture corrected feed material 66. The moisture corrected feed material 66 is typically carried to an extruder 14 by another conveyor system 72. The extruder 14 receives the moisture corrected feed material 66 and shapes it into a long column representing the length and width of a desired brick.

Figure 2:
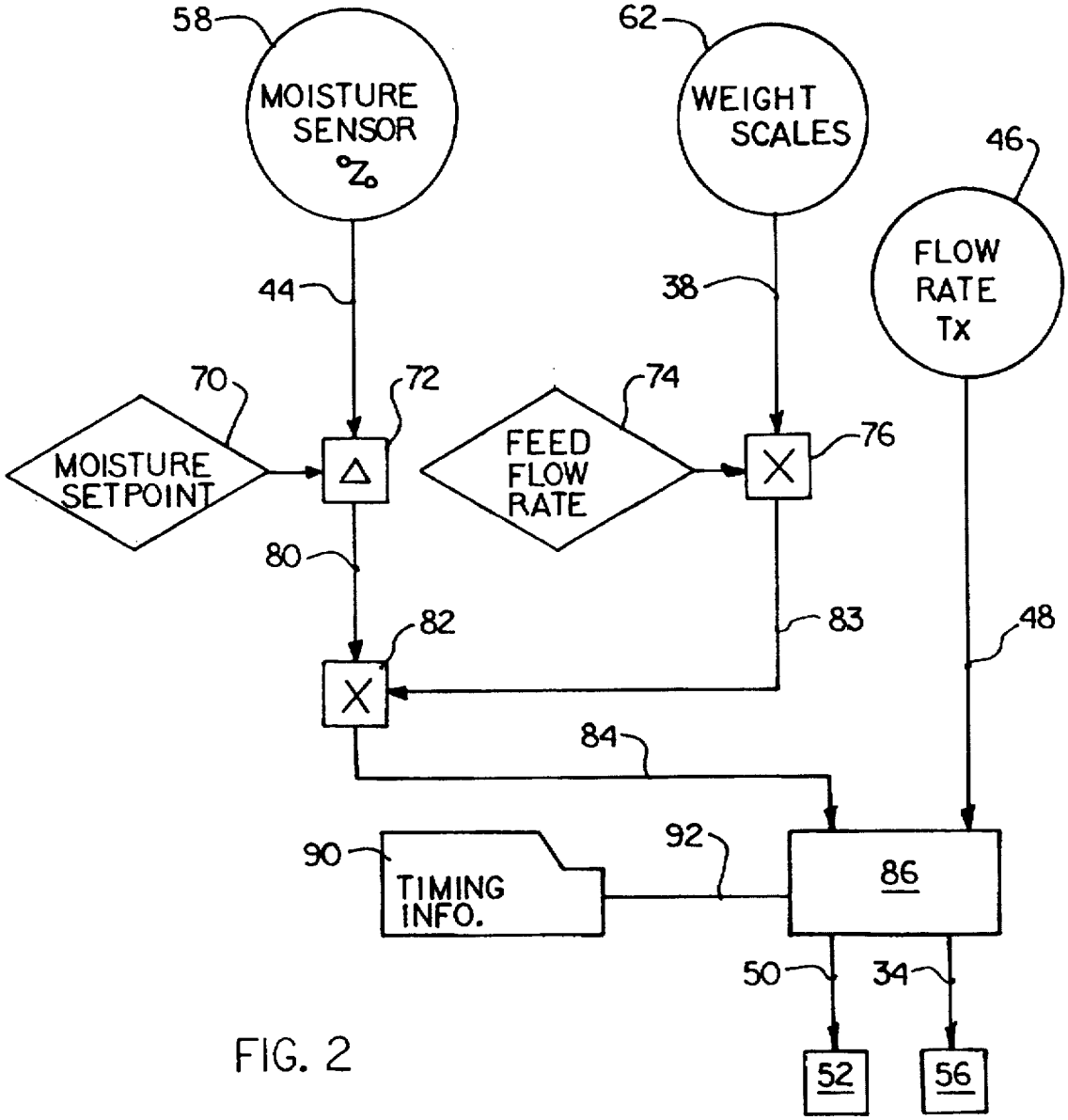
FIG. 2 is a schematic representation of the controller for the water flow control system shown in FIG. 1.

Now focusing on FIG. 2, the controller 18 includes three inputs: the percent moisture signal 44 from the moisture sensor 58, the weight signal 38 from the weight scales 62, and the water flow rate signal 48 from the water flow rate transmitter 46. The notation used is conventional and is listed under SAMA standard RC22-11-1966. The percent moisture signal 44 is subtracted from a percent moisture set point 70 in processor block 72. A rezoning output signal 80 represents the moisture percentage deficiency in the feed material 64.

The weight signal 38 is multiplied by the flow rate 74 of the feed material 64 in processor block 76 resulting in an output signal 83 representing a weight per unit of time of the feed material 64. For example, output signal 83 would signify an amount of feed material per hour. At this point, the output signal 83 representing the amount of feed material per unit of time is multiplied in processor block 82 by the control signal 80 representing the percent moisture deficiency resulting in a output signal 84 representing the tons of water to add per unit of time. At this point, the controller 18 has determined the amount of water to add to the feed material 64 on the conveyor system 70; however, the water cannot be added until the feed material 64 reaches the pug mill 12 and the spray nozzles 32 and 42. The controller 18 handles this problem by storing timing information 90 regarding the time it takes for the feed material 64 to travel from the scales 62 to the moisture analyzer 58 and further to the pug mill 12. The timing information 90 supplies enough information to the controller 18 to ensure that the portion of feed material 64 weighed on scales 62 is the same portion of feed material 64 providing a moisture reading at moisture sensor 58, and ultimately, is the same portion of feed material 64 that receives the correct amount of additional water given the information supplied by the prior sensor stages. The timing information 90 is sent to processing block 86 via control signal 92 along with control signal 84 representing the amount of water to add per unit of time and the water flow rate signal 48. Processor block 86 receives this information and provides two outputs. The primary output is the flow rate control signal 50 which controls the flow rate control valve 52 thereby providing the appropriate amount of water to spray nozzles 32. The water flow rate can be measured in the output line 24 of pump 20 because water is not compressible and therefore the flow rate near the pump 20 is the same as the flow rate provided to the nozzles 32. An optional second output is the auxiliary flow rate control signal 34 controlling the auxiliary flow rate control valve 56, which, as discussed above, controls additional flow nozzles 42 when the water flow is greater than a predetermined set point. Those skilled in the art will realize that the controller 18 may include any existing or later developed process controller or microprocessor-based control device.

The water flow control system of the present invention allows for very accurate and repeatable water flow. Since it is automatic, there is no need for constant monitoring of water flow. The system defies the teachings of modern control theory and known brick making methods by removing moisture feedback after the feed material has passed through the pug mill 12 and/or the extruder 14. The system has replaced the conventional methods of using dye oil pressure or pug mill motor amperage readings after the water has been added with a relatively small and lightweight moisture sensor 58 and weight scales 62 prior to the pug mill 12. The system provides extremely precise moisture inducement into the feed material 64, thereby providing a better and more consistent resulting brick product.

Certain modifications and improvements will occur to those skilled in the art upon a reading of the foregoing description. By way of example, the microwave moisture sensor may be replaced with any number of known or later developed moisture sensing devices. Also, the manner of determining the rate of flow of the feed material may be moved to a different location along the conveyor system or replaced by another means of determining feed material flow rate. For example, in a system where the feed material flow rate is a constant value, this value can be inputted directly into the controller to calculate the amount of water to be added. It should be understood that all such modifications and improvements have been deleted herein for the sake of conciseness and readability but are properly within the scope of the following claims.

I claim:

1. An apparatus for controlling the flow of water to a pug mill, said apparatus comprising:

(a) a pug mill for mixing water with a stream of clay feed material;

(b) a water supply system connected to said pug mill, said water supply system including a supply of water and a first control valve for controlling the flow of water to said pug mill;

(c) a moisture sensor for measuring the moisture content of said feed material upstream of said pug mill; and (d) a controller connected between said moisture sensor and said first control valve for receiving a signal representative of a moisture content of said feed material and providing a control signal to said first control valve to control the flow of water to said pug mill;

wherein said water supply system further includes an inlet line connected to a supply of water; a pump connected to said inlet line; an outlet line connected between said pump and said pug mill; a return loop connected between said outlet line and said inlet line; and a flow bypass for selectively controlling the flow of water between said pug mill and said return loop.

2. The apparatus according to claim 1, wherein said flow bypass includes a second control valve in said outlet line downstream of said return loop and a third control valve in said return loop.

3. The apparatus according to claim 2, wherein said second control valve is normally closed and said third control valve is normally open.

4. The apparatus according to claim 1, wherein said water supply system includes a plurality of spray nozzles located in said pug mill.

5. The apparatus according to claim 1, wherein said moisture sensor is a microwave moisture sensor.

6. A control system for an apparatus for controlling the flow of water from a water supply to a pug mill for mixing water with a stream of clay feed material received from a feed material supply upstream of said pug mill, said control system comprising:

(a) a moisture sensor located adjacent to said feed material supply for providing a moisture signal representative of the moisture content of the feed material upstream said pug mill;

(b) a flow transmitter located between said water supply and said pug mill for providing a water flow signal representative of the water flow to said pug mill;

(c) a control valve located between said water supply and said pug mill for controlling the flow of water to said pug mill; and (d) a controller connected between said moisture sensor, said flow transmitter and said first control valve for receiving said moisture signal and said water flow signal and providing a water control signal to said control valve to control the flow of water to said pug mill;

wherein said feed material supply includes a weight measuring device for providing a weight signal representative of the weight of said feed material, said weight signal used by controller in conjunction with said moisture signal to determine the amount of water to add when said feed material reaches said pug mill with said water control signal.

7. The apparatus according to claim 6, wherein said moisture sensor includes a skid to ride on said feed material being supplied to said pug mill by said feed material supply.

8. The apparatus according to claim 7, wherein said skid has a raised front tip for preventing said skid from digging into said feed material.

9. The apparatus according to claim 7, wherein said feed material is at ambient temperature and said skid further includes a heater for heating said skid above said ambient temperature enough to prevent said feed material from sticking to said skid.

10. The apparatus according to claim 9, wherein said skid is heated about 20° F. above said ambient temperature of said feed material.

11. The apparatus according to claim 7, wherein said skid supporting said moisture sensor is formed from a ceramic material.

12. The apparatus according to claim 6, wherein said feed material supply includes a conveyor for continuously supplying said feed material to said moisture sensor and then to said pug mill.

13. The apparatus according to claim 12, wherein said feed material supply further includes a particle deflector upstream of said moisture sensor for deflecting unwanted particles in said feed material from said feed supply.

14. The apparatus according to claim 6, wherein said feed material supply includes a conveyor for continuously moving said feed material by said moisture sensor and said weight measuring device prior to supplying said feed material to said pug mill.

15. The apparatus according to claim 14, wherein said conveyor includes a conveyor belt on which said feed material rides and under which said weight measuring device is placed, thereby allowing said conveyor belt to deflect onto said weight measuring device and provide an accurate measurement of feed material weight.

16. The apparatus according to claim 6 further including a moisture sensor mount, wherein said moisture sensor is held at a constant orientation with respect to said feed material to help prevent errors in moisture sensing.

17. The apparatus according to claim 6, wherein said controller delays the addition of water to said feed material in said pug mill according to the amount of time for said feed material to travel from said moisture sensor and said weight measuring device to said pug mill.

18. The apparatus according to claim 6, wherein said moisture sensor is a microwave moisture sensor.

19. A control system for an apparatus for controlling the flow of water from a water supply to a pug mill for mixing water with a stream of clay feed material received from a feed material supply upstream of said pug mill, said control system comprising:

(a) a moisture sensor located adjacent to said feed material supply for providing a moisture signal representative of the moisture content of the feed material upstream said pug mill;

(b) a flow transmitter located between said water supply and said pug mill for providing a water flow signal representative of the water flow to said pug mill;

(c) a control valve located between said water supply and said pug mill for controlling the flow of water to said pug mill; and (d) a controller connected between said moisture sensor, said flow transmitter and said first control valve for receiving said moisture signal and said water flow signal and providing a water control signal to said control valve to control the flow of water to said pug mill; wherein said controller includes a water control output and said controller delays the addition of water to said feed material in said pug mill according to the amount of time for said feed material to travel from said moisture sensor to said pug mill.

20. The apparatus according to claim 19, wherein said feed supply further includes a weight measuring device for providing a weight signal representative of the weight of said feed material, said weight signal used by controller in conjunction with said moisture signal to determine the amount of water to add when said feed material reaches said pug mill with said water control signal.

21. The apparatus according to claim 20, wherein said feed material supply includes a conveyor for continuously moving said feed material by said moisture sensor and said weight measuring device prior to supplying said feed material to said pug mill.

22. The apparatus according to claim 21, wherein said conveyor includes a conveyor belt on which said feed material rides and under which said weight measuring device is placed, thereby allowing said conveyor belt to deflect onto said weight measuring device and provide an accurate measurement of feed material weight.

23. The apparatus according to claim 20, wherein said controller delays the addition of water to said feed material in said pug mill according to the amount of time for said feed material to travel from said moisture sensor and said weight measuring device to said pug mill.

24. The apparatus according to claim 19, wherein said moisture sensor includes a skid to ride on said feed material being applied to said pug mill by said feed material supply.

25. The apparatus according to claim 24, wherein said skid has a raised front tip for preventing said skid from digging into said feed material.

26. The apparatus according to claim 24, wherein said feed material is at ambient temperature and said skid further includes a heater for heating said skid above said ambient temperature enough to prevent said feed material from sticking to said skid.

27. The apparatus according to claim 26, wherein said skid is heated about 20 °F. above said ambient temperature of said feed material.

28. The apparatus according to claim 24, wherein said skid supporting said moisture sensor is formed from a ceramic material.

29. The apparatus according to claim 19, wherein said feed material supply includes a conveyor for continuously supplying said feed material to said moisture sensor and then to said pug mill.

30. The apparatus according to claim 29, wherein said feed material supply further includes a particle deflector upstream of said moisture sensor for deflecting unwanted particles in said feed material from said feed supply.

31. The apparatus according to claim 19 further including a moisture sensor mount, wherein said moisture sensor is held at a constant orientation with respect to said feed material to help prevent errors in moisture sensing.

32. The apparatus according to claim 19, wherein said moisture sensor is a microwave moisture sensor.

33. An apparatus for controlling the flow of water to a pug mill, said apparatus comprising:

(a) a pug mill for mixing water with a stream of clay feed material;

(b) a water supply system connected to said pug mill, said water supply system including a supply of water and a first control valve for controlling the flow of water to said pug mill, wherein said water supply system further includes an inlet line connected to a supply of water; a pump connected to said inlet line; an outlet line connected between said pump and said pug mill; a return loop connected between said outlet line and said inlet line; and a flow bypass for selectively controlling the flow of water between said pug mill and said return loop;

(c) a moisture sensor located adjacent to said feed material supply for providing a moisture signal representative of the moisture content of the feed material upstream said pug mill;

(d) a flow transmitter located between said water supply and said pug mill for providing a water flow signal representative of the water flow to said pug mill; and (e) a controller connected between said moisture sensor, said flow transmitter and said first control valve for receiving said moisture signal and said water flow signal and providing a water control signal to said control valve to control the flow of water to said pug mill.

34. The apparatus according to claim 33, wherein said flow bypass includes a second control valve in said outlet line downstream of said return loop and a third control valve in said return loop.

35. The apparatus according to claim 34, wherein said second control valve is normally closed and said third control valve is normally open.

36. The apparatus according to claim 33, wherein said water supply system includes a plurality of spray nozzles located in said pug mill.

37. The apparatus according to claim 33, wherein said moisture sensor is a microwave moisture sensor.

38. The apparatus according to claim 33, wherein said feed supply further includes a weight measuring device for providing a weight signal representative of the weight of said feed material, said weight signal used by controller in conjunction with said moisture signal to determine the amount of water to add when said feed material reaches said pug mill with said water control signal.

39. The apparatus according to claim 38, wherein said feed material supply includes a conveyor for continuously moving said feed material by said moisture sensor and said weight measuring device prior to supplying said feed material to said pug mill.

40. The apparatus according to claim 39, wherein said conveyor includes a conveyor belt on which said feed material rides and under which said weight measuring device is placed, thereby allowing said conveyor belt to deflect onto said weight measuring device and provide an accurate measurement of feed material weight.

41. The apparatus according to claim 38, wherein said controller includes a water control output, said controller delays the addition of water to said feed material in said pug mill according to the amount of time for said feed material to travel from said moisture sensor and said weight measuring device to said pug mill.

42. The apparatus according to claim 33, wherein said moisture sensor includes a skid to ride on said feed material being supplied to said pug mill by said feed material supply.

43. The apparatus according to claim 42, wherein said skid has a raised front tip for preventing said skid from digging into said feed material.

44. The apparatus according to claim 42, wherein said feed material is at ambient temperature and said skid further includes a heater for heating said skid above said ambient temperature enough to prevent said feed material from sticking to said skid.

45. The apparatus according to claim 44, wherein said skid is heated about 20° F. above said ambient temperature of said feed material.

46. The apparatus according claim 42, wherein said skid supporting said moisture sensor is formed from a ceramic material.

47. The apparatus according to claim 33, wherein said feed material supply includes a conveyor for continuously supplying said feed material to said moisture sensor and then to said pug mill.

48. The apparatus according to claim 47, wherein said feed material supply further includes a particle deflector upstream of said moisture sensor for deflecting unwanted particles in said feed material from said feed supply.

49. The apparatus according to claim 33, wherein said moisture sensor is held at a constant orientation with respect to said feed material to help prevent errors in moisture sensing.

50. The apparatus according to claim 33, wherein said controller includes a water control output, said controller delays the addition of water to said feed material in said pug mill according to the amount of time for said feed material to travel from said moisture sensor to said pug mill.

51. The apparatus according to claim 33, wherein said moisture sensor is a microwave moisture sensor.

52. A method for controlling the flow of water to a pug mill for mixing water with a clay feed material received from a feed material supply upstream of said pug mill from a water supply system connected to said pug mill, said water supply system including a supply of water and a first control valve for controlling the flow of water to said pug mill, said method comprising the steps of:

(a) providing a moisture signal representative of the moisture content of the feed material upstream said pug mill using a moisture sensor located adjacent to said feed material supply;

(b) providing a water flow signal representative of the water flow to said pug mill using a flow transmitter located between said water supply and said pug mill;

(c) controlling the flow of water to said pug mill using a control valve located between said water supply and said pug mill;

(d) receiving said moisture signal and said water flow signal and providing a water control signal to said control valve to control the flow of water to said pug mill; and (e) delaying the addition of water to the feed material in the pug mill according to an amount of time for said feed material to travel from said moisture sensor to the pug mill.

* * * * *